US011783964B2

(12) United States Patent
Ishikawa

(10) Patent No.: US 11,783,964 B2
(45) Date of Patent: Oct. 10, 2023

(54) DIFFERENTIAL SIGNAL TRANSMISSION CABLE

(71) Applicant: Proterial, Ltd., Tokyo (JP)

(72) Inventor: Hiroshi Ishikawa, Tokyo (JP)

(73) Assignee: Proterial, Ltd., Tokyo (JP)

( * ) Notice: Subject to any disclaimer, the term of this patent is extended or adjusted under 35 U.S.C. 154(b) by 0 days.

(21) Appl. No.: 17/398,265

(22) Filed: Aug. 10, 2021

(65) Prior Publication Data

US 2022/0084717 A1 Mar. 17, 2022

(30) Foreign Application Priority Data

Sep. 14, 2020 (JP) ..... 2020-153507

(51) Int. Cl.

| | |
|---|---|
| ***H01B 11/06*** | (2006.01) |
| ***H01B 7/02*** | (2006.01) |
| ***H01B 7/22*** | (2006.01) |
| ***H01B 11/00*** | (2006.01) |

(52) U.S. Cl.

CPC ..... *H01B 7/0241* (2013.01); *H01B 7/221* (2013.01); *H01B 11/002* (2013.01)

(58) Field of Classification Search

CPC ..... H01B 11/002; H01B 11/06

See application file for complete search history.

(56) References Cited

U.S. PATENT DOCUMENTS 4,125,739 A * 11/1978 Bow ..... H01B 11/1016 428/41.5
4,268,714 A * 5/1981 Mori ..... B32B 15/12 174/109
4,322,574 A * 3/1982 Bow ..... H01P 1/30 428/377
4,647,714 A * 3/1987 Goto ..... B32B 15/04 174/394
4,965,408 A * 10/1990 Chapman ..... B32B 15/08 174/363
4,973,794 A * 11/1990 Steele ..... H01B 11/203 174/103
5,434,354 A * 7/1995 Baker ..... H01B 11/1091 174/115
6,225,556 B1 * 5/2001 Saito ..... H01F 1/14725 148/668
6,504,379 B1 * 1/2003 Jackson ..... H01B 7/0861 174/117 F
10,366,811 B2 * 7/2019 Kobayashi ..... H01B 11/20
11,087,904 B2 * 8/2021 Kobayashi ..... H01B 7/08
2015/0170800 A1 6/2015 Sugiyama
2017/0370026 A1 * 12/2017 Perera ..... D02G 3/36

FOREIGN PATENT DOCUMENTS

JP 2015115246 A 6/2015

* cited by examiner

*Primary Examiner* — Chau N Nguyen

(74) *Attorney, Agent, or Firm* — McCormick, Paulding & Huber PLLC

(57) ABSTRACT

A differential signal transmission cable includes: an insulating electric wire having a pair of conductive wires and an insulating layer covering the pair of conductive wires; a shield tape wound around an outer periphery of the insulating electric wire; a first tape wound around an outer periphery of the shield tape and having a first resin covering layer; and a second tape wound around an outer periphery of the first tape and having a second covering layer. The second covering layer is made of a high softening point material having a softening point that is higher than a softening point of the first resin covering layer.

9 Claims, 2 Drawing Sheets

DIFFERENTIAL SIGNAL TRANSMISSION CABLE

CROSS-REFERENCE TO RELATED APPLICATION

The present application claims priority from Japanese Patent Application No. 2020-153507 filed on Sep. 14, 2020, the content of which is hereby incorporated by reference into this application.

TECHNICAL FIELD OF THE INVENTION

The present invention relates to a differential signal transmission cable, and particularly relates to a differential signal transmission cable comprising a press-winding tape for pressing a shield tape.

BACKGROUND OF THE INVENTION

In equipment that handles high-speed digital signals, a differential signal is transmitted by using a differential signal transmission cable. The differential signal is advantageous in that resistance to external noise can be improved while achieving a lower voltage of a system power supply. In addition, in the differential signal transmission cable, a method is performed in which a shield tape serving as a shield layer with no differential suck-out is longitudinally lapped and wound around an outer periphery of an insulating electric wire.

For example, Japanese Patent Application Laid-Open Publication No. 2015-115246 (Patent Document 1) discloses an insulating electric wire in which a pair of signal line conductors are collectively covered by an insulator, a shield tape longitudinally lapped and wound around an outer periphery of the insulating electric wire, and two layers of press-winding tape spirally wound around an outer periphery of the shield tape. In addition, the two layers of press-winding tape each have a resin layer and an adhesive layer, and each adhesive layer is adhered to the other.

SUMMARY OF THE INVENTION

However, in the longitudinally lapped and wound shield tape, voids are present inside (insulating electric wire side) the shield tape, and if distribution of the voids is uneven with respect to a circumferential direction of the insulating electric wire, mode conversion noise becomes larger and signal transmission becomes difficult. Namely, performance of the differential signal transmission cable decreases. In particular, when a diameter of a conductive wire in the insulating electric wire is reduced, the above-described voids are more likely to generate at the time of manufacturing the differential signal transmission cable.

Therefore, a technique capable of suppressing generation of the above-described voids as much as possible and suppressing a decrease in performance of the differential signal transmission cable is desired. Other objects and novel features will be apparent from the following description and accompanying drawings.

The differential signal transmission cable according to one embodiment of the present invention comprises: an insulating electric wire having a pair of conductive wires and an insulating layer covering the pair of conductive wires; a shield tape wound around an outer periphery of the insulating electric wire; a first tape wound around an outer periphery of the shield tape and having a first resin covering layer; and a second tape wound around an outer periphery of the first tape and having a second covering layer. The second covering layer is made of a high softening point material having a softening point that is higher than a softening point of the first resin covering layer.

According to the embodiment, a decrease in performance of the differential signal transmission cable can be suppressed.

BRIEF DESCRIPTIONS OF THE DRAWINGS

DESCRIPTION OF PREFERRED EMBODIMENTS

Hereinafter, an embodiment of the present invention will be described with reference to the drawings. Note that, in all of the drawings used to describe the embodiment, members having the same functions are denoted by the same reference signs, and redundant descriptions thereof are omitted as appropriate. In addition, in the following embodiment, descriptions of the same or similar components will not be repeated in principle unless otherwise particularly necessary.

Embodiment

<Configuration of Differential Signal Transmission Cable 1>

Figure 1:
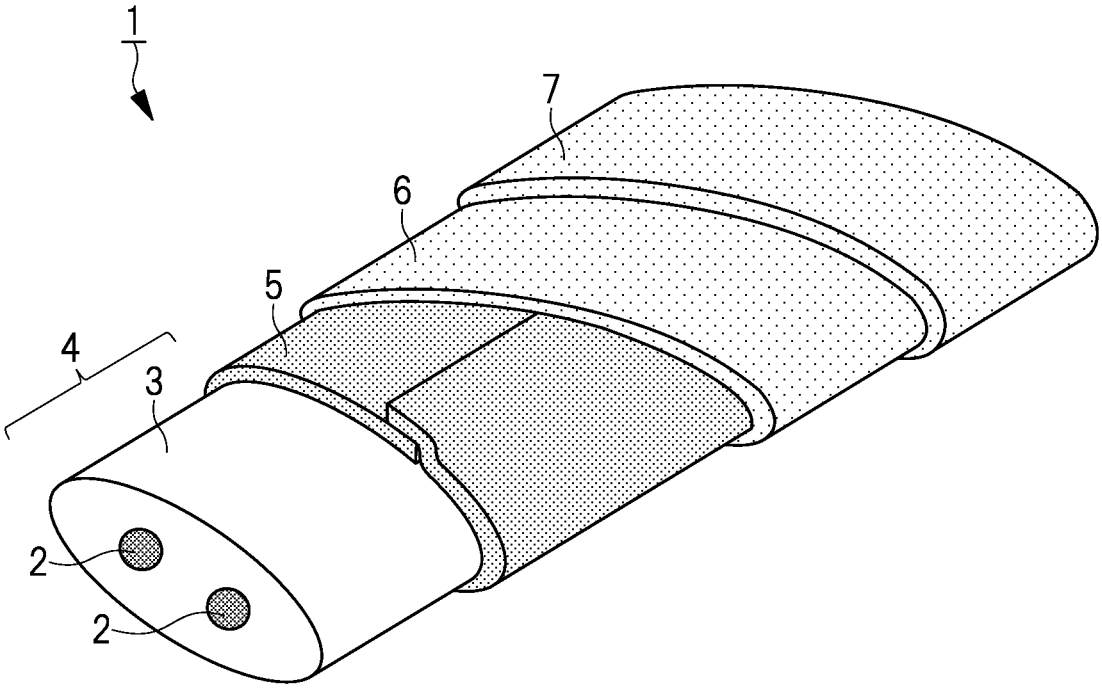
FIG. 1 is a perspective view showing a differential signal transmission cable in an embodiment.
Figure 2:
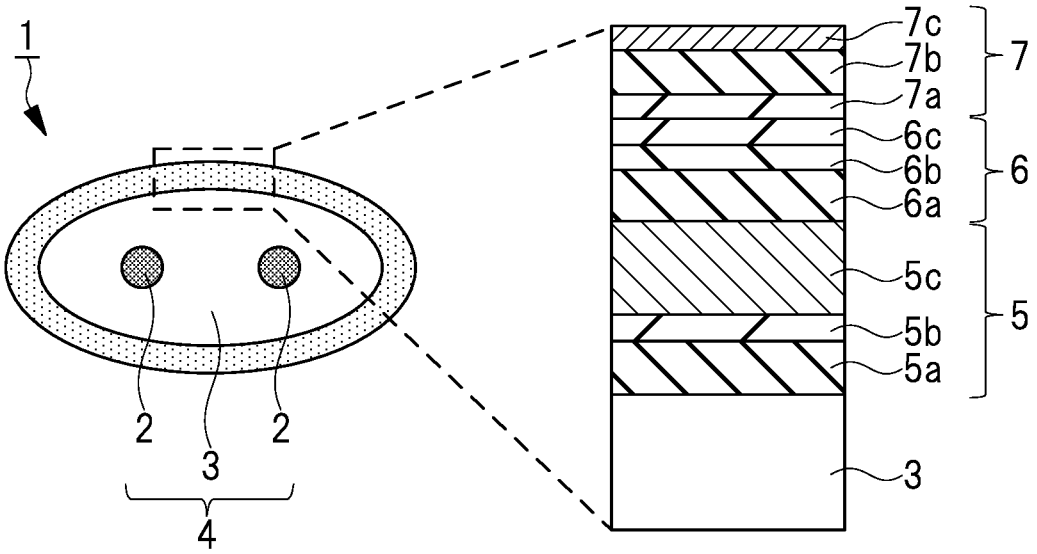
FIG. 2 is a cross-sectional view showing the differential signal transmission cable in the embodiment.

Hereinafter, a differential signal transmission cable 1 according to an embodiment will be described with reference to FIGS. 1 and 2. FIG. 1 is a perspective view showing the differential signal transmission cable 1. FIG. 2 is a cross-sectional view of the differential signal transmission cable 1, and is a cross section taken along a perpendicular direction with respect to an extension direction of the differential signal transmission cable 1.

As shown in FIG. 1, the differential signal transmission cable 1 comprises an insulating electric wire 4 having a pair of conductive wires 2 and an insulating layer 3 covering the pair of conductive wires 2. The differential signal transmission cable 1 further comprises a shield tape 5 wound around an outer periphery of the insulating electric wire 4, a tape 6 wound around an outer periphery of the shield tape 5, and a tape 7 wound around an outer periphery of the tape 6.

The shield tape 5 is longitudinally lapped and wound around the outer periphery of the insulating electric wire 4, and the tape 6 and the tape 7 are spirally wound around the outer periphery of the shield tape 5. Specifically, the tape 6 is spirally wound around the outer periphery of the shield tape 5, and the tape 7 is spirally wound around the outer periphery of the tape 6. The tape 6 and the tape 7 are provided to press and fix the longitudinally lapped and wound shield tape 5, and to allow the shield tape 5 to be in close contact with the insulating electric wire 4. Therefore, in the following description, the tape 6 will be referred to as the press-winding tape 6, and the tape 7 will be referred to as the press-winding tape 7.

In addition, the press-winding tape 6 and the press-winding tape 7 are wound in the same direction. In FIG. 1, the press-winding tape 6 and the press-winding tape 7 are wound to the right (Z winding). However, the press-winding tape 6 and the press-winding tape 7 may be wound to the left (S winding).

In addition, the differential signal transmission cable 1 is provided with a jacket (not shown) covering an outer periphery of the press-winding tape 7 and being made of a resin material such as vinyl chloride, silicon rubber or fluoropolymer.

Note that, in the present application, expressions such as "shield tape 5 wound around the outer periphery of the insulating electric wire 4" or "shield tape 5 covering the outer periphery of the insulating electric wire 4" mean that the insulating electric wire 4 is located around the shield tape 5. These expressions include a case where the insulating electric wire 4 and the shield tape 5 are in direct contact with each other, and also include a case where a space or another structure is present between the insulating electric wire 4 and the shield tape 5, and the insulating electric wire 4 and the shield tape 5 are adjacent to each other via said space or said structure. Such a definition is not limited to be applied to a relation between the insulating electric wire 4 and the shield tape 5, but also applies to a relation between other structures such as the press-winding tape 6 and the press-winding tape 7.

The conductive wire 2 is a single wire made of, for example, a metallic material such as copper or copper alloy. A plating layer made of a metallic material such as silver may be formed on a surface of the conductive wire 2. A positive polarity (positive) signal is transmitted to one of the pair of conductive wires 2, and a negative polarity (negative) signal is transmitted to the other of the pair of conductive wires 2. In addition, a cross-sectional shape of each of the pair of conductive wires 2 is circular, and a diameter of each of the pair of conductive wires is 0.1601 mm (34 AWG) or less.

The insulating layer 3 is made of, for example, a resin material such as polyethylene or fluoropolymer, and is formed by, for example, an extrusion technique using an extruder. Examples of fluoropolymer include fluorinated ethylene propylene (FEP), perfluoroalkoxy alkane (PFA), polytetrafluoroethylene (PTFE), ethylene tetrafluoroethylene (ETFE). The insulating layer 3 may be constituted by a foamable resin material such as foamable polyethylene. In addition, a cross-sectional shape of the insulating layer 3 is oval, a major diameter of the insulating layer 3 is 1.25 mm or less, and a minor diameter of the insulating layer 3 is 0.71 mm or less. The insulating electric wire 4 is constituted by such a pair of conductive wires 2 and insulating layer 3.

FIG. 2 is an enlarged cross-sectional view showing a detailed cross-sectional structure of the shield tape 5, the press-winding tape 6 and the press-winding tape 7 covering the outer periphery of the insulating electric wire 4.

The shield tape 5 has a resin layer 5*a* (fourth resin covering layer) covering an outer periphery of the insulating layer 3, and a shield layer 5*c* covering an outer periphery of the resin layer 5*a*. In addition, the shield tape 5 has an adhesive layer 5*b* provided between the insulating layer 3 and the shield layer 5*c* in order to adhere the resin layer 5*a* to the shield layer 5*c*.

The resin layer 5*a* is made of, for example, a resin material such as polyethylene terephthalate (PET) which is a type of polyester. The adhesive layer 5*b* is made of, for example, a thermoplastic resin material. The shield layer 5*c* is made of, for example, a metallic material such as copper, copper alloy or aluminum. In addition, a thickness of the resin layer 5*a* is, for example, 2.0 μm to 7.0 μm, a thickness of the adhesive layer 5*b* is, for example, 1.0 μm to 3.0 μm, and a thickness of the shield layer 5*c* is, for example, 6.0 μm to 10.0 μm.

The press-winding tape 6 (first tape) has a resin layer 6*a* (first resin covering layer) and a colored layer 6*b* covering an outer periphery of the resin layer 6*a*. The resin layer 6*a* and the colored layer 6*b* are each made of, for example, a resin material such as polyethylene terephthalate (PET) which is a type of polyester. In addition, the resin material constituting the colored layer 6*b* includes a dye. A thickness of the resin layer 6*a* is, for example, 3.0 μm to 4.0 μm, and a thickness of the colored layer 6*b* is, for example, 1.0 μm to 2.0 μm.

The press-winding tape 7 (second tape) has a resin layer 7*b* (third resin covering layer) and a high softening point material layer 7*c* (second covering layer) covering an outer periphery of the resin layer 7*b*. The resin layer 7*b* is made of, for example, a resin material such as polyethylene terephthalate (PET) which is a type of polyester. The high softening point material layer 7*c* is made of, for example, a highly flexible metallic material such as aluminum, copper or copper alloy, or a resin material with a high melting point such as polyimide or polytetrafluoroethylene (PTFE). In addition, a thickness of the resin layer 7*b* is, for example, 3.0 μm to 4.0 μm.

In a case where the high softening point material layer 7*c* is made of a metallic material or a resin material as described above, its thickness is, for example, 1.0 μm to 15.0 μm. Preferably, the high softening point material layer 7*c* is made of aluminum, and its thickness is, for example, 1.0 μm to 4.0 μm. Most preferably, the high softening point material layer 7*c* is made of aluminum, and its thickness is, for example, 1.0 μm to 2.0 μm which is thinner than the thickness of each of the resin layer 6*a* and the resin layer 7*b*.

In addition, the press-winding tape 6 has an adhesive layer 6*c* covering an outer periphery of the colored layer 6*b*, and the press-winding tape 7 has an adhesive layer 7*a* provided on an inner periphery side of the resin layer 7*b*. The adhesive layer 6*c* and the adhesive layer 7*a* are each made of, for example, a thermoplastic resin material. In addition, a thickness of each of the adhesive layer 6*c* and the adhesive layer 7*a* is, for example, 1.0 μm to 2.0 μm. In addition, in case where the adhesive layer 7*a* can be directly adhered to the high softening point material layer 7*c*, the resin layer 7*b* need not be provided.

Note that, in FIG. 2, the adhesive layer 6*c* and the adhesive layer 7*a* are shown separately in order to make each configuration easier to understand. As will be described in detail below, the adhesive layer 6*c* and the adhesive layer 7*a* are subjected to heat treatment in order to adhere the press-winding tape 6 to the press-winding tape 7. The heated adhesive layer 6*c* and adhesive layer 7*a* soften and integrate with each other. Therefore, in the present application, the adhesive layer 6*c* and the adhesive layer 7*a* provided between the resin layer 6*a* and the resin layer 7*b* may be collectively referred to as one "adhesive layer".

The high softening point material layer 7*c* is made of a metallic material or a resin material as described above, and is made of a material that is more difficult to soften than the resin layer 6*a*, the resin layer 7*b* and the adhesive layer (adhesive layer 6*c*, adhesive layer 7*a*). In other words, the high softening point material layer 7*c* is made of a material having a softening point that is higher than a softening point of the resin layer 6*a* and a softening point of the resin layer 7*b*, and is made of a material having a softening point that is higher than a softening point of the adhesive layer (adhesive layer 6*c*, adhesive layer 7*a*). That is, the high softening point material layer 7*c* is made of a metallic material or a resin material having a melting point that is higher than those softening points.

A main feature of the present embodiment is that the high softening point material layer 7*c* is included in the press-winding tape 7. Before describing such a feature, novel issues that the inventor has found through examinations will be described.

<Regarding Items Examined by Inventor>

Figure 3:
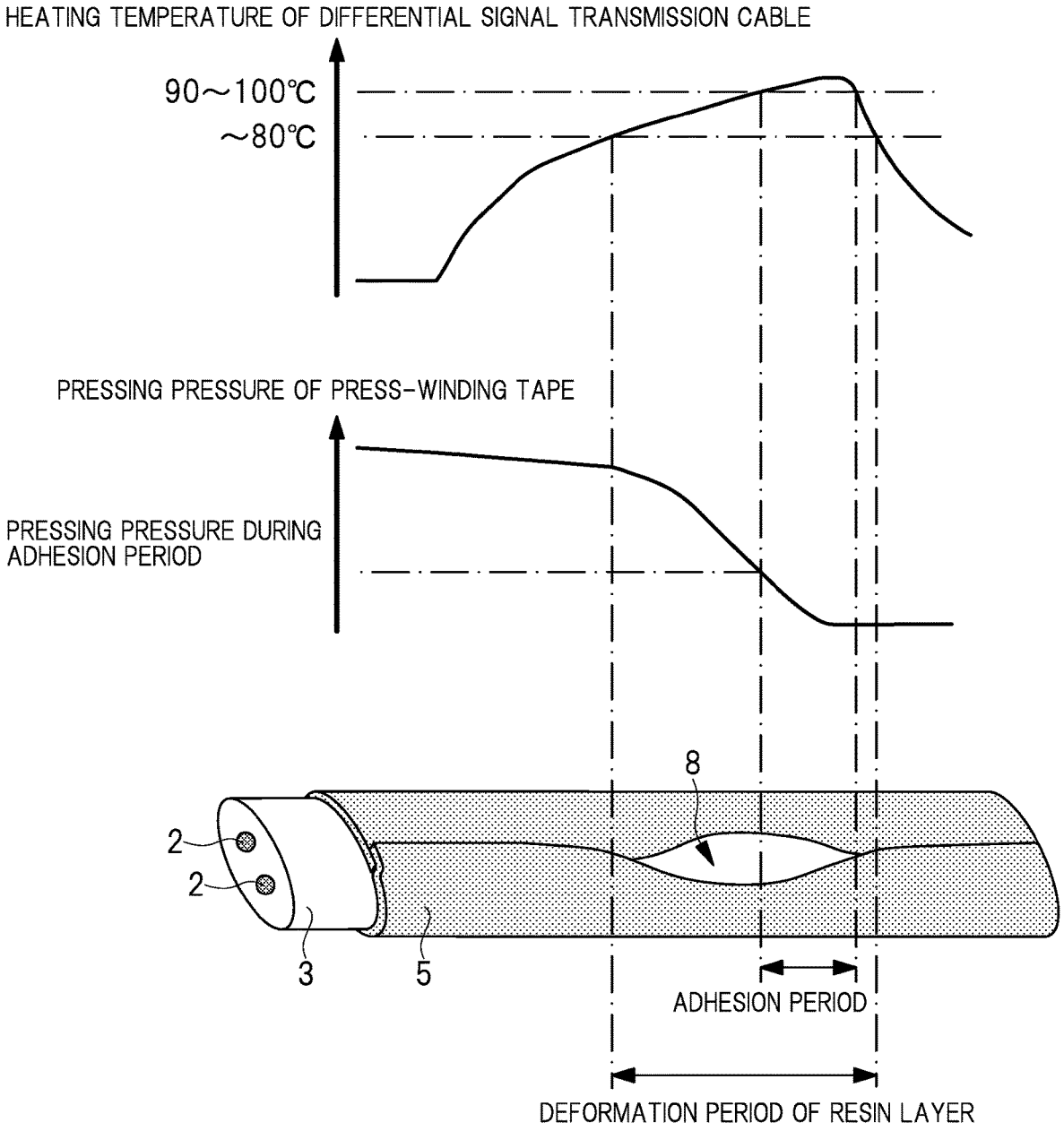
FIG. 3 is an explanatory diagram showing a problem in which a void is generated in a shield tape.

FIG. 3 is an explanatory diagram showing a problem in which a void is generated in the shield tape 5. Note that the differential signal transmission cable 1 shown in FIG. 3 is not provided with the high softening point material layer 7*c*.

In a manufacturing method of the differential signal transmission cable 1, it is necessary to adhere the press-winding tape 6 to the press-winding tape 7 by using the adhesive layer 6*c* and the adhesive layer 7*a* in order to suppress fraying at the time of cutting a terminal of the differential signal transmission cable 1. For this reason, the differential signal transmission cable 1 is, for example, brought into a heating furnace, and then, the adhesive layer 6*c* and the adhesive layer 7*a* are subjected to the heat treatment.

FIG. 3 shows a relation between a heating temperature of the differential signal transmission cable 1, a pressing pressure which is a pressure with which the press-winding tape 6 and the press-winding tape 7 are pressed against the shield tape 5, and a schematic view of the void generated in the shield tape 5.

In addition, in FIG. 3, a period in which the heating temperature becomes 80° C. or higher is shown as a deformation period of the resin layer (resin layer 6*a*, resin layer 7*b*), and a period in which the heating temperature is 90° C. to 100° C. is shown as an adhesion period of the adhesive layer (adhesive layer 6*c*, adhesive layer 7*a*).

The thermoplastic resin material has a property in which it softens when heated to a predetermined temperature and then hardens when the temperature is lowered. Here, a heating temperature of about 90° C. to 100° C. is necessary to soften the adhesive layer 6*c* and the adhesive layer 7*a* made of a thermoplastic resin material. In this case, the resin layer 6*a* and the resin layer 7*b* made of a resin material such as polyester would soften from about 80° C. This causes the press-winding tape 6 and the press-winding tape 7 to be stretched and the pressing pressures of the press-winding tape 6 and the press-winding tape 7 to be reduced, further causing a void 8 to generate in the shield tape 5.

In addition, after the above-described heat treatment, the pressing pressures of the press-winding tape 6 and the press-winding tape 7 remain small, so that the void 8 generated in the shield tape 5 cannot be closed.

In particular, in a case where a diameter of the differential signal transmission cable 1 is reduced, that is, in a case where a diameter of each of the pair of conductive wires is set to 34 AWG (0.1601 mm) or less, a major diameter of the insulating layer 3 is set to 1.25 mm or less, and a minor diameter of the insulating layer 3 is set to 0.71 mm or less, a force with which the shield tape 5 presses the press-winding tape 6 and the press-winding tape 7 becomes stronger. Therefore, when the resin layer 6*a* and the resin layer 7*b* soften, the force with which the shield tape 5 presses the press-winding tape 6 and the press-winding tape 7 is more likely to become relatively stronger, and the void 8 is more likely to generate in the shield tape 5.

Here, as a method to suppress generation of the void 8, it can be considered to apply a resin material having a higher softening point than polyester such as polyimide or polytetrafluoroethylene (PTFE) to the resin layer 6*a*. However, in such a case, it would be difficult to form a sufficiently thin layer of polyimide or polytetrafluoroethylene (PTFE) which is the material of the resin layer in an economical manner. Therefore, the thickness of the press-winding tape 6 would increase in a case where a material available for practical use is used.

If the thickness of the press-winding tape 6 is too thick, it would be difficult to smoothly wind the press-winding tape 6 around the outer periphery of the shield tape 5, and the void 8 is more likely to generate in the shield tape 5. On the other hand, the press-winding tape 7 is provided to mainly prevent separation of the press-winding tape 6, so that the press-winding tape 7 is not required to be smoother than the press-winding tape 6. In other words, the thickness of the press-winding tape 7 can be thicker than that of the press-winding tape 6.

Main Features of Present Embodiment

In consideration of the above, the press-winding tape 7 having the high softening point material layer 7*c* is applied in the present embodiment. As described above, the high softening point material layer 7*c* is made of a material having a softening point that is higher than the softening points of the resin layer 6*a* and the softening point of the resin layer 7*b*, and is made of a material having a softening point that is higher than the softening point of the adhesive layer (adhesive layer 6*c*, adhesive layer 7*a*). In addition, the high softening point material layer 7*c* is made of a metallic material or a resin material having a melting point that is higher than those softening points.

Here, the high softening point material layer 7*c* does not soften in the above-described heat treatment. Thus, even if the resin layer 6*a* and the resin layer 7*b* soften, the pressing pressure from the high softening point material layer 7*c* suppresses elongation of the press-winding tape 6 and the press-winding tape 7, so that the pressing pressures of the press-winding tape 6 and the press-winding tape 7 are maintained.

Therefore, the shield tape 5 can be pressed and fixed, allowing the shield tape 5 to be in close contact with the insulating electric wire 4, so that generation of the void 8 can be suppressed. Thus, according to the present embodiment, a decrease in performance of the differential signal can be suppressed.

In addition, in the present embodiment, it is possible to make the thickness of the high softening point material layer 7*c* thinner than the thickness of each of the resin layer 6*a* and the resin layer 7*b*. The high softening point material layer 7*c* having a thickness just enough to maintain the pressing pressure is added to the press-winding tape 7, so that the thickness of each of the press-winding tape 6 and the press-winding tape 7 can be suppressed from becoming thicker than necessary. Thus, the press-winding tape 6 and the press-winding tape 7 can be smoothly wound around the outer periphery of the shield tape 5. Therefore, according to the present embodiment, the diameter of the differential signal transmission cable 1 can be easily reduced.

In the foregoing, the present invention has been concretely described based on the embodiment. However, the present invention is not to be limited to the foregoing embodiment, and various modifications can be made within the scope of the present invention.

For example, in the above-described embodiment, a case where the high softening point material layer 7*c* is made of a metallic material such as aluminum, copper or copper alloy, or a resin material with a high melting point such as polyimide or polytetrafluoroethylene (PTFE) has been described. However, the material constituting the high softening point material layer 7*c* may be any other material if the material is difficult to soften.

In addition, in the above-described embodiment, a case where the high softening point material layer 7*c* is a single layer has been described. However, the high softening point material layer 7*c* may be constituted by a plurality of layers. In such a case, the material constituting each of the layers may differ from each other if the materials are difficult to soften. However, in consideration of an increase in the thickness of the press-winding tape 7, if the high softening point material layer 7*c* is constituted by the plurality of layers, it is preferable that a total thickness of each layer is the same as when the high softening point material layer 7*c* is a single layer.

What is claimed is:

1. A differential signal transmission cable comprising:

an insulating electric wire having a pair of conductive wires and an insulating layer covering the pair of conductive wires;

a shield tape wound around an outer periphery of the insulating electric wire;

a first tape wound around an outer periphery of the shield tape and having a first covering layer; and a second tape wound around an outer periphery of the first tape and having a second covering layer, an adhesive layer provided between the first covering layer and the second covering layer, and being made of a thermoplastic resin material, wherein the first covering layer is made of a resin, the second covering layer is made of a high softening point material having a softening point that is higher than a softening point of the first covering layer, the softening point of the high softening point material is higher than a softening point of the adhesive layer, the shield tape is longitudinally lapped and wound around the outer periphery of the insulating electric wire, wherein the first tape is spirally wound around the outer periphery of the shield tape the second tape is spirally wound around the outer periphery of the first tape, the second covering layer is provided on the outermost side of the second tape, wherein a cross-sectional shape of the insulating layer is oval, a major diameter of the insulating layer is 1.25 mm or less, and a minor diameter of the insulating layer is 0.71 mm or less, and wherein the second covering layer is made of polyimide or polytetrafluoroethylene.

2. The differential signal transmission cable according to claim 1, wherein the second tape further has a third covering layer, provided between the adhesive layer and the second covering layer, the third covering layer is made of a resin, and the softening point of the high softening point material is higher than a softening point of the third covering layer.

3. The differential signal transmission cable according to claim 2, wherein the shield tape has a fourth covering layer and a shield layer covering an outer periphery of the fourth covering layer, the fourth covering layer is made of a resin, and the shield layer is made of a first metallic material.

4. The differential signal cable according to claim 2, wherein a thickness of the second covering layer is thinner than a thickness of third covering layer.

5. The differential signal transmission cable according to claim 1, wherein the first covering layer is made of polyester.

6. The differential signal transmission cable according to claim 1, wherein the second covering layer is made of a first metallic material having a melting point that is higher than the softening point of the first covering layer.

7. The differential signal transmission cable according to claim 6, wherein the first metallic material includes aluminum, copper or copper alloy.

8. The differential signal transmission cable according to claim 1, wherein a cross-sectional shape of each of the pair of conductive wires is circular, and a diameter of each of the pair of conductive wires is 34 AWG or less.

9. The differential signal transmission cable according to claim 1, wherein a thickness of the second covering layer is thinner than a thickness of the first covering layer.

* * * * *